United States Patent [19]

Denzin et al.

[11] Patent Number: 5,035,327

[45] Date of Patent: Jul. 30, 1991

[54] RECEPTACLE ADAPTABLE FOR NESTED STACKING

[75] Inventors: Dirk E. Denzin; Robert E. Lull, both of West Bend; Alan J. Schommer, Fredonia, all of Wis.

[73] Assignee: The Vollrath Company, Inc., Sheboygan, Wis.

[21] Appl. No.: 614,039

[22] Filed: Nov. 15, 1990

Related U.S. Application Data

[63] Continuation of Ser. No. 463,113, Jan. 11, 1990, abandoned.

[51] Int. Cl.[5] ..... B65D 21/02

[52] U.S. Cl. ..... 206/518; 206/519

[58] Field of Search ..... 206/518, 519, 515, 503

[56] References Cited

U.S. PATENT DOCUMENTS

| | | | |
|---|---|---|---|
| D. 277,632 | 2/1985 | Staufenberg | D7/629 |
| D. 277,993 | 3/1985 | Sinchok | D34/44 |
| 2,814,427 | 11/1957 | Emery | 206/519 X |
| 3,233,812 | 2/1966 | Kennedy | 206/518 |
| 3,326,408 | 6/1967 | Ringler | 206/518 X |
| 3,358,879 | 12/1967 | Mueller | 206/519 |
| 3,539,552 | 11/1970 | Mounts et al. | 206/519 |
| 3,884,383 | 5/1975 | Burch et al. | 206/519 X |
| 4,113,095 | 9/1978 | Dietz et al. | 206/518 X |
| 4,298,156 | 11/1981 | Reifers et al. | 206/519 X |
| 4,660,734 | 4/1987 | Heaney et al. | 206/519 X |
| 4,828,112 | 5/1989 | Vollrath et al. | 206/519 |

FOREIGN PATENT DOCUMENTS

| | | | |
|---|---|---|---|
| 1370755 | 7/1964 | France | 206/518 |
| 1281997 | 7/1972 | United Kingdom | 206/519 |

OTHER PUBLICATIONS

Cambro Manufacturing Corp., "1989 Cambro Catalog", Jan. 1, 1990, pp. 18-21.

Polar Ware Co., "Food Service" Catalog, May 1988, pp. 1-3.

The Vollrath Company, Product Brochure Form No. 35001, 1986.

Cambro Manufacturing Co., "Product News", Nov. 15, 1978.

Rubbermaid Commercial Products, Inc., "Rubbermaid Food Specialists" Brochure, May, 1978.

*Primary Examiner*—Bryon P. Gehman

*Attorney, Agent, or Firm*—Foley & Lardner

[57] ABSTRACT

A receptacle adaptable for nested stacking which has a bottom and walls which cooperate to form an open-topped well having rounded corners defined by a first radius. The receptacle includes a plurality of stop structures for limiting depth of insertion of adjacent receptacles in a nested orientation, which stop structures are preferably located at the corners of the well and comprise an integrally formed depression and an associated shelf in each corner.

The shelf is generally planar and generally horizontal and has a boundary adjacent the well which is defined by a second radius, larger than the first radius which defines the corners.

The depression has a first portion and a second portion. The first portion preferably depends outwardly of the well substantially from the boundary of the shelf and extends beyond a vertical line intersecting the boundary. The first portion is pitched outward of the vertical line from the boundary of the shelf. When measured in a plane which bisects the corner, the vertical line and the first portion subtend an acute angle.

The second portion of the depression joins the first portion with the corner and presents a generally downward facing first abutting surface which spans the intersection of the boundary of the shelf of the next adjacent lower receptacle with a plane, the plane establishing a desired depth of insertion of the upper receptacle within the lower receptacle in a nested orientation.

3 Claims, 2 Drawing Sheets

RECEPTACLE ADAPTABLE FOR NESTED STACKING

This is a continuation of application Ser. No. 07/463,113 filed Jan. 11, 1990, now abandoned.

BACKGROUND OF THE INVENTION

The present invention is directed to a receptacle, such as a pan, which is adaptable for nested stacking.

The advantages of nested stacking of receptacles for storage have long been recognized. Principal among those advantages is the reduced space occupied during storage, and a lesser susceptibility to damage of receptacles stored in a nested orientation.

The employment of shoulders, flutes, corrugations, embossings, ridges, and other means of enlarging the perimeter of a receptacle to preclude jamming of adjacent receptacles during nested stacking is known. For example, U.S. Pat. No. 3,233,812 to T. B. Kennedy, for a "Molded Pulp Container", discloses a bumper 16 to provide a nesting capability; U.S. Pat. No. 4,113,095 to Dietz et al., for "Tray-Type Processed Food Containers", discloses horizontal corner corrugations 15 and wider corner ledge portions 19 to provide a nesting capability; U.S. Pat. No. 4,298,156 to Reifers et al., for "Nestable and Denestable Molded Egg Cartons", discloses narrow lobes 41 and wide lobes 40 to provide a nesting capability; U.S. Pat. No. 4,660,734 to Heaney et al., for a "Steam Table Pan", discloses a gusset 50 to provide a nesting capability; and U.S. Pat. No. 4,828,112 to Vollrath et al., for a "Metal Transport Pan", discloses an outwardly-protruding ridge 40 to provide a nesting capability.

Similar structures are disclosed in U.S. Pat. No. Des. D277,632 to Staufenberg, for a "Food Storage Dish"; and Design Patent No. D277,993 to Sinchok, for a "Stackable Utility Basket".

Still further, the employment of a shoulder or similar structure to prevent jamming during nested stacking is disclosed in a Rubbermaid Commercial Product Incorporated brochure entitled "Rubbermaid Food Specialists", dated May, 1978; in a Cambro "Product News" flyer, No. 25, dated Nov. 15, 1978; in a Vollrath product brochure, Form No. 35001, dated 1986; in a Polar Ware "Food Service" product brochure, dated May, 1988; and in a 1989 Cambro Catalog, dated Jan. 1, 1989.

Thus, the employment of shoulders or similar structures to increase the perimetric dimensions of a receptacle to provide a nestable stacking capability is known. However, problems with jamming of adjacent nested receptacles employing such structures are still experienced.

Such adjacent receptacles may jam because of interaction between walls of the adjacent receptacles. That is, such receptacles are often stacked during normal use in a wet condition and a suction effect between adjacent walls can be experienced which will render separation of the adjacent receptacles more difficult, and further serves to impede drying of such adjacent stacked receptacles.

All of the earlier structures which employ integrally formed shoulder-type structures at corners of a receptacle to provide a nesting capability provide a straight-drop structure for the shoulder structure. That is, the shoulder depends vertically downward in its departure from the corner. With such a straight-drop structure, the taper of the side walls of the receptacle provides the displacement which gives rise to a nesting stop surface presented by the shoulder to a next adjacent receptacle in a nested orientation. In such structures, variations in manufacturing tolerances or flexibility of receptacle walls may present improper clearances between adjacent receptacles. Such improper clearances may enable an upper receptacle to slip within a lower receptacle and jam in the lower receptacle, even with the projecting shoulder or other structure present, thereby rendering de-nesting of the two receptacles difficult.

The present invention provides a receptacle adaptable for nested stacking which presents a firm seat for nested stacking which will better accommodate dimensional differences among receptacles than did prior art structures, which limits contact between adjacent receptacles to areas in the vicinity of the corners of the receptacles, and which provides a stand-off between walls of adjacent nested receptacles to preclude creation of a suction effect between adjacent such receptacles, as well as to promote drying of stacked receptacles.

SUMMARY OF THE INVENTION

The invention is a receptacle adaptable for nested stacking which, in its preferred embodiment, has a generally planar, generally horizontal, polygonal bottom and a plurality of walls. The bottom and the walls cooperate to form an open-topped well having rounded corners defined by a first radius, and a top end. The walls are convergently oriented toward the bottom to provide a taper for easy nesting of the receptacles.

The invention includes a plurality of stop structures for limiting depth of insertion of adjacent receptacles in a nested orientation, which stop structures are preferably located at the corners of the well and comprise an integrally formed depression and an associated shelf in each corner.

The shelf is generally planar and generally horizontal and has a boundary adjacent the well which is defined by a second radius, larger than the first radius which defines the corners.

The depression has a first portion and a second portion. The first portion preferably depends outwardly of the well substantially from the boundary of the shelf and extends beyond a vertical line intersecting the boundary. The first portion is pitched outward of the vertical line from the boundary of the shelf. When measured in a plane which bisects the corner, the vertical line and the first portion subtend an acute angle. In the preferred embodiment, the acute angle may range from approximately 3° to 10°.

The second portion of the depression joins the first portion with the corner and presents a generally downward facing first abutting surface which spans the intersection of the boundary of the shelf of the next adjacent lower receptacle with a plane, the plane establishing a desired depth of insertion of the upper receptacle within the lower receptacle in a nested orientation.

The shelf presents a second, generally upward facing, abutting surface appropriate to engage the first abutting surface presented by a next adjacent upper receptacle in a nested orientation. The first abutting surface preferably spans the boundary of the respective lower adjacent shelf in a nested orientation.

It is therefore an object of the present invention to provide a receptacle adaptable for nested stacking which provides reliable firm stacking in a nested orientation.

A further object of the present invention is to provide a receptacle adaptable for nested stacking which precludes jamming between adjacent receptacles in a nested orientation.

Yet a further object of the present invention is to provide a receptacle adaptable for nested stacking which precludes interaction between walls of adjacent receptacles in a stacked orientation.

Still a further object of the present invention is to provide a receptacle adaptable for nested stacking which promotes drying of receptacles in a nested orientation.

Further objects and features of the present invention will be apparent from the following specification and claims when considered in connection with the accompanying drawings illustrating the preferred embodiment of the invention.

DETAILED DESCRIPTION OF THE DRAWINGS

DETAILED DESCRIPTION OF THE INVENTION

Figure 1:
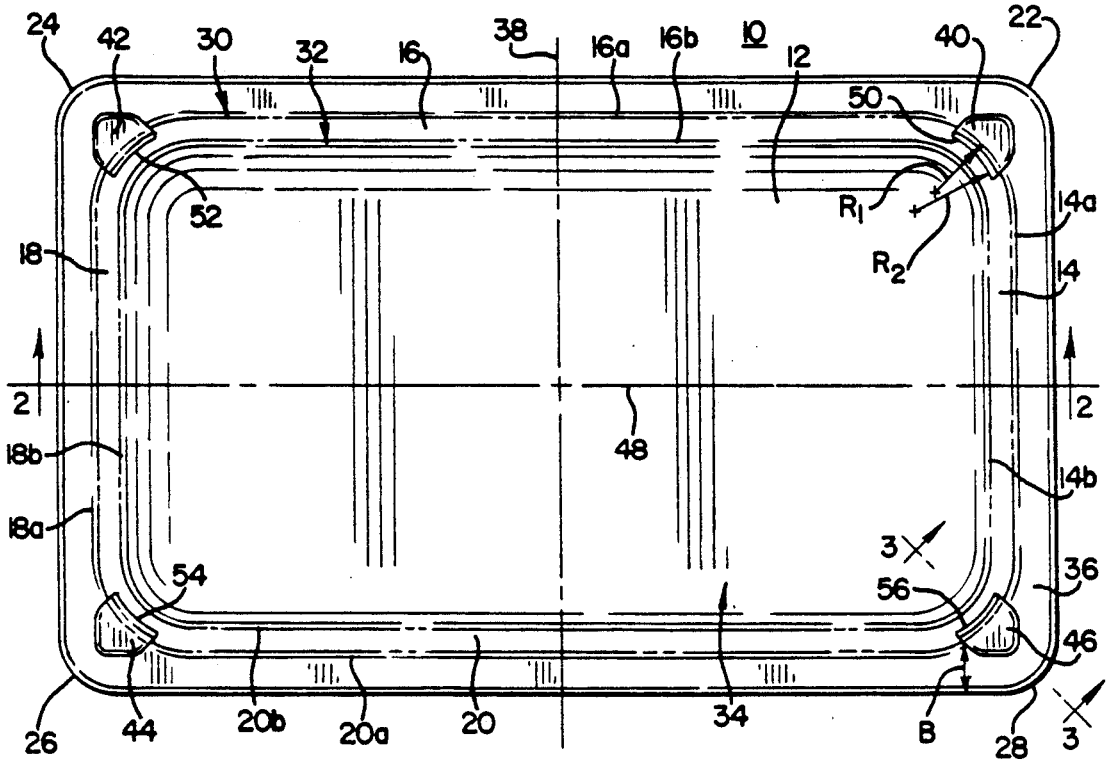
FIG. 1 is a top plan view of the preferred embodiment of the present invention.

In FIG. 1, a top plan view of a receptacle 10 is illustrated. The receptacle 10 has a bottom 12, preferably of generally rectangular shape, and a plurality of walls 14, 16, 18, and 20. Walls 14 and 16 meet in a corner 22, walls 16 and 18 meet in a corner 24, walls 18 and 20 meet in a corner 26, and walls 20 and 14 meet in a corner 28. The receptacle 10 is symmetrical about vertical plane 38, and also is symmetrical about vertical plane 48.

Wall 14 terminates in an upper terminus **14*a* and a lower terminus 14*b*, wall 16 terminates in an upper terminus 16*a* and a lower terminus 16*b*, wall 18 terminates in an upper terminus 18*a* and a lower terminus 18*b*, and wall 20 terminates in an upper terminus 20*a* and a lower terminus 20*b*. The various termini 14*a*, 16*a*, 18*a*, 20*a* form a common upper terminus 30, and the various lower termini 14*b*, 16*b*, 18*b*, 20*b* form a common lower terminus 32**.

The common upper terminus 30 generally lies in an upper plane and the common lower terminus 32 generally lies in a lower plane. Preferably the upper plane is substantially parallel with the lower plane. The walls 14, 16, 18, 20 are tapered to facilitate nesting engagement of the receptacle within a second receptacle so that the common upper terminus 30 subtends a larger area in the upper plane than the area subtended by the common lower terminus 32 in the lower plane.

Thus, the bottom 12 and the walls 14, 16, 18, 20 cooperate to form an open-topped well 34. The corners 22, 24, 26, and 28 are rounded and are generally defined by a first radius $R_1$. The walls 14, 16, 18, 20 are extended upward past the common upper terminus 30 to form a rolled bead 36 which serves to strengthen the receptacle.

Situated at each of the corners are substantially planar shelves 40, 42, 44, and 46. The shelves 40, 42, 44, and 46 are each formed as a depression in the bead 36 with the shelf 40 being situated at corner 22, the shelf 42 being situated at corner 24, the shelf 44 being situated at corner 26, and the shelf 46 being situated at corner 28. Each of the shelves 40, 42, 44, and 46 is preferably of a generally irregular pentagonal shape, as illustrated in FIG. 1, and has a boundary 50, 52, 54, 56 adjacent the well 34. The boundaries 50, 52, 54, 56 are defined by a radius $R_2$; $R_2$ is greater than radius $R_1$, which defines the corners 22, 24, 26, 28.

To facilitate understanding the present invention, like elements will be identified by like reference numerals in the various drawings.

Figure 2:
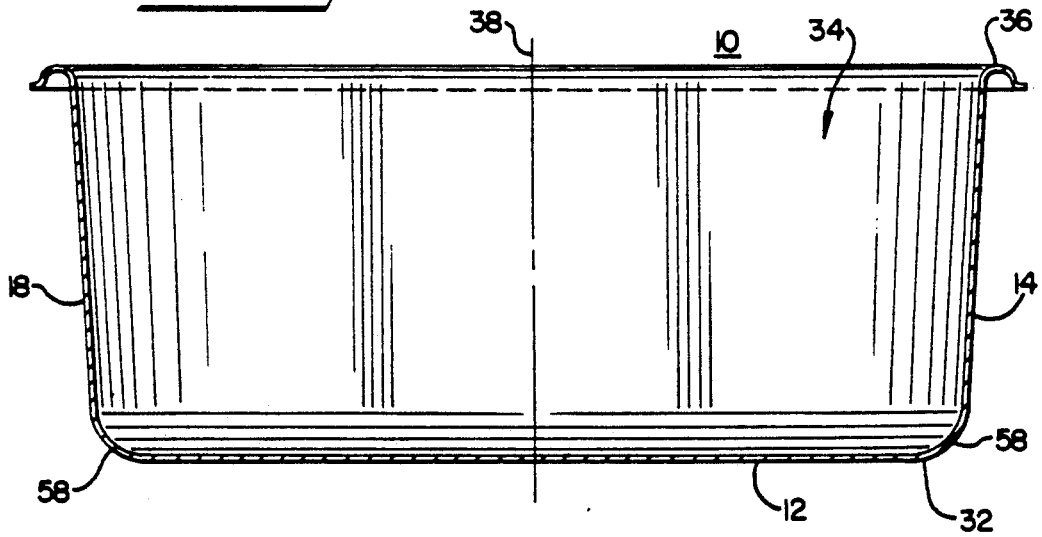
FIG. 2 is a front section view of the preferred embodiment of the present invention, taken along Section 2—2 of FIG. 1.

FIG. 2 is a front section view of the preferred embodiment of the receptacle 10, taken along Section 2—2 of FIG. 1. In FIG. 2, bottom 12 is shown as having a rounded juncture 58 with walls 14 and 18. The receptacle 10 is symmetrical about vertical plane 38 and the walls 14, 18 have a rolled bead structure 36. The rounded juncture 58 is present throughout the perimeter of the common lower terminus 32.

Figure 3:
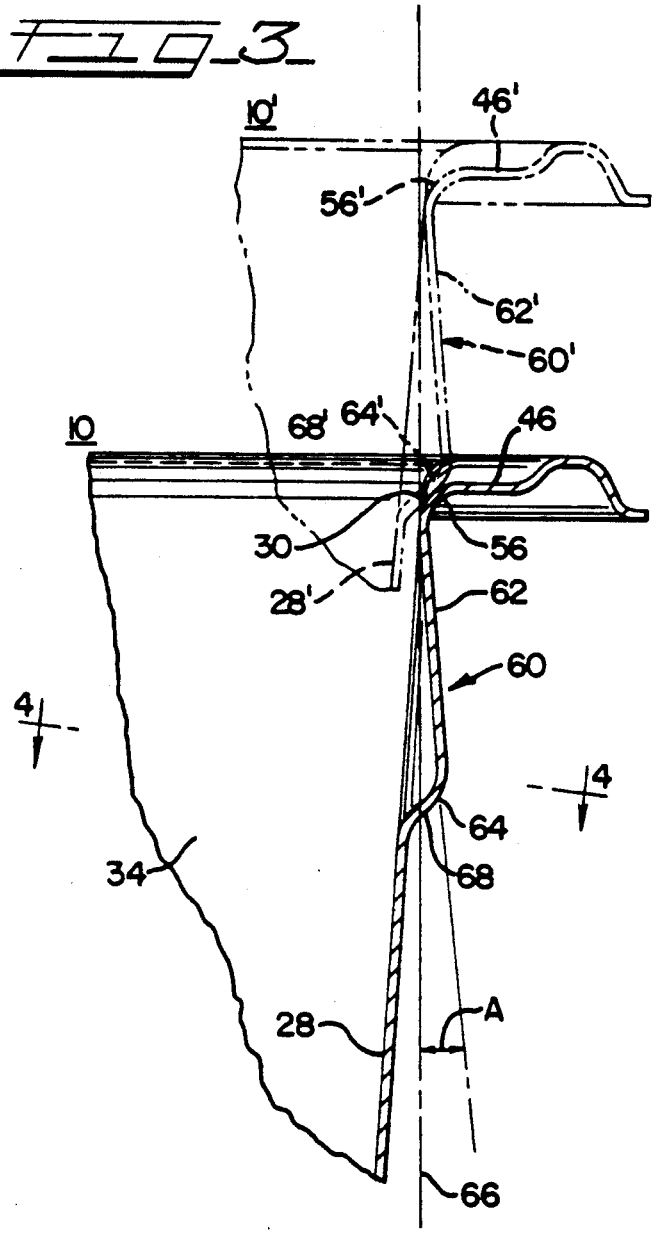
FIG. 3 is a section view of a portion of a corner of the preferred embodiment of the present invention taken along Section 3—3 of FIG. 1, with a similar section view of a portion of a corner of a next adjacent upper receptacle in a stacked orientation illustrated in phantom.

FIG. 3 is a section view of a portion of a corner of the receptacle 10 taken along Section 3—3 of FIG. 1. In FIG. 3, a stop structure 60 is illustrated as located at a corner, such as corner 28. A section view of a portion of a corner of a next adjacent upper receptacle 10' is illustrated in phantom.

The stop structure 60 is preferably bi-directional and consists of the shelf 46, a first portion 62, and a second portion 64. First portion 62 preferably depends from boundary 56 outwardly of well 34 and forms an acute angle A with a vertical line 66. Vertical line 66 is contained within the section plane of Section 3—3 of FIG. 1 and intersects boundary 56. Preferably, vertical line 66 is perpendicular both with the plane containing the common upper terminus 30 and with the plane containing the common lower terminus 32 (not shown in FIG. 3).

Lower portion 64 joins upper portion 62 with corner 28 and presents a generally downward facing first abutting surface 68 for engagement with an adjacent lower receptacle (not shown in FIG. 3) in a nested orientation. The corner 28' of the receptacle 10', shown in phantom in FIG. 3, likewise has a stop structure 60' comprising a shelf 46' with a boundary 56', an upper portion 62', and a lower portion 64'. Lower portion 64' presents a generally downward facing first abutting surface 68' which, in a nested orientation, is engaged with shelf 46 of adjacent lower receptacle 10, as illustrated in FIG. 3. Thus, shelf 46 presents a generally upward facing second abutting surface for engagement by first abutting surface 68' of receptacle 10' in a nested orientation.

Bi-directional stop structure 60, with its provision of downward facing first abutting surface 68 and the upward facing second abutting surface of shelf 46, provides a definitive stop engagement for nested receptacles 10, 10'. The provision of the upward facing second abutting surface provided by the shelf 46 is of particular importance, since the larger radius $R_2$ of boundary 6 (FIG. 1) ensures that contact between receptacle 10' and receptacle 10 occurs only at corners 22, 4, 26, 28, and thereby further ensures that a gap is established in a nested orientation between walls 14, 16, 18, 20 of adjacent nested receptacles. Such a gap between walls ensures that no suction effect is created between walls of nested receptacles 10, 10', and further, allows sufficient air flow between receptacles 10, 10' to promote drying in a nested orientation.

Provision of the larger radius $R_2$ of boundary 56 also provides that acute angle A may be a lesser value than would be possible without the positive stop effect provided by upward facing second abutting surface created by boundary 56 and shelf 46. This precludes having to displace material outward in corner 28 beyond acceptable limits of ductility to form stop structure 60.

Figure 4:
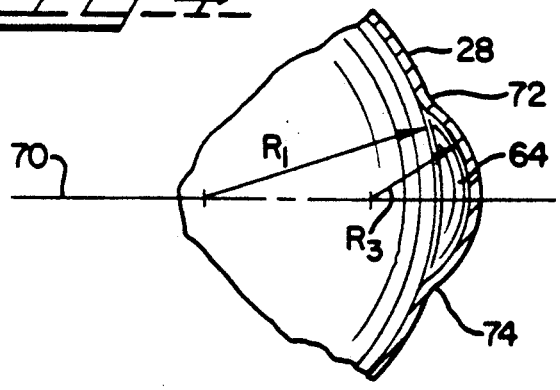
FIG. 4 is a section view of the portion of the corner of the receptacle illustrated in FIG. 3, taken along Section 4—4 of FIG. 3.

The gusset-like construction of stop structure 60 is illustrated in FIG. 4. FIG. 4 is a section view of the portion of corner 28 of receptacle 10, taken along Section 4—4 of FIG. 3. In FIG. 4, corner 28 is defined by radius $R_1$, and lower portion 64 is shown as spanning a bisecting plane 70 and rejoining corner 28 at junctures 72 and 74. Lower portion 64 is defined by a radius $R_3$; radius $R_3$ is less than radius $R_1$. Stop structures 60 at the various corners 22, 24, 26, 28 also lend strength to receptacle 10 by their gusset-like construction.

Shelves 40, 42, 44, 46 provide other advantages to receptacle 10. Each shelf 40, 42, 44, 46 is of a generally wide expanse, given the area available for it to occupy in the bead 36, which expanse enhances cleaning of residues which may collect during use of receptacle 10 for food service or the like. Further, shelves 40, 42, 44, 46 provide handy thumb grips for a user in lifting receptacle 10, as well as provide pouring spouts to focus the traverse of liquids from well 34 when receptacle 10 is appropriately tipped toward a respective corner 22, 24, 26, 28.

The manufacture of receptacle 10, in particular the formation of shelves 40, 42, 44, 46, inherently establishes larger radius $R_2$ in defining boundaries 50, 52, 54, 56. The stamping tooling employed to form shelves 40, 42, 44, 46 shoves material toward boundaries 50, 52, 54, 56. Such displacement of an amount of material toward well 34, and an appropriate shaping of the tool, establishes larger radius $R_2$.

The shape of each shelf 40, 42, 44, 46 establishes a widened expanse B of bead 36 (FIG. 1) adjacent each respective shelf, as illustrated in connection with shelf 46 in FIG. 1. Widened expanse B of bead 36 serves to limit the bend line which likely will occur when receptacle 10 is dropped on corner 46 (a common occurrence in the use of such receptacles, for example, in the food service industry). By thus structurally predetermining the likely bend line in the event of dropping, the likelihood is increased that a user could rebend corner 46 to approximately its original orientation. Hence, the useful life of receptacle 10 is increased.

Preferably, radius $R_3$, which defines lower portion 64, and the radius (not shown) which defines upper portion 62 of stop structure 60 are sufficient to allow easy clean-out of stop structure 60.

It is to be understood that, while the detailed drawings and specific examples given describe preferred embodiments of the invention, they are for the purpose of illustration only, that the apparatus of the invention is not limited to the precise details and conditions disclosed, and that various changes may be made therein without departing from the spirit of the invention which is defined by the following claims.

We claim:

1. A receptacle adaptable for nested stacking comprising:

a plurality of walls, each of said plurality of walls having a top end and a bottom end, said top end terminating in an upper terminus, said upper terminus generally lying in an upper plane, said bottom end terminating in a lower terminus, said lower terminus generally lying in a lower plane;

a bottom, said bottom joining said plurality of walls at said lower terminus, said bottom and said plurality of walls cooperating to form a well having a plurality of corners, each of said corners being defined by intersection of two adjacent of said plurality of walls, said plurality of walls being convergently disposed between said upper plane and said lower plane, said upper terminus defining a first area in said upper plane and said lower terminus defining a second area in said lower plane, said first area being larger than said second area; and stop means for limiting depth of insertion of the receptacle within an adjacent lower receptacle of the same construction in a nested orientation;

said stop means comprising a plurality of projections, said plurality of projections being distributed among said plurality of corners, each of said plurality of projections being integrally formed with said plurality of walls and having a first portion and a second portion, said first portion depending from a respective corner of said plurality of corners outwardly of said well generally from said upper terminus and defining an acute angle in a sectional plane with respect to a reference plane, said reference plane perpendicularly intersecting said upper plane at said upper terminus at said respective corner, said sectional plane substantially bisecting said respective corner and being generally perpendicular to said reference plane, said second portion joining said first portion with said plurality of walls and presenting a first abutting surface to said adjacent lower receptacle of the same construction in a nested orientation; said stop means further comprising a substantially planar shelf positioned at each of said plurality of corners, each said shelf lying generally parallel with said upper plane and above said first portion, each respective corner of said plurality of corners being of rounded configuration having a first radius, each said shelf being terminated adjacent said well by a boundary having a second radius, said second radius being greater than said first radius, each said shelf presenting a second abutting surface for engaging said first abutting surface of an adjacent upper receptacle in a nested orientation.

2. An improved receptacle adaptable for nested stacking, said receptacle being generally symmetrical about a vertical plane and having a generally polygonal bottom and a plurality of walls, said bottom and said plurality of walls cooperating to form an open-topped well having a plurality of corners and a top end, the improvement comprising a plurality of stop means for limiting depth of insertion of the receptacle within an adjacent lower receptacle in a nested orientation, said plurality of stop means being distributed among said plurality of corners, each of said plurality of stop means comprising an integrally formed depression in a respective corner of said plurality of corners, said depression depending outwardly of said well and including a first portion and a second portion, said first portion depending from said respective corner at a first intersection toward said bottom and defining an acute angle with a reference line; said reference line intersecting said first intersection and being parallel with said vertical plane in a reference plane, said reference plane substantially containing said respective corner; said second portion joining said first portion with said respective corner at a second intersection and presenting a first abutting surface to an adjacent lower receptacle in a nested orientation; said stop means further comprising a generally planar shelf positioned at each of said plurality of corners, each said shelf lying generally in a horizontal plane above said first portion, said horizontal plane being substantially perpendicular with said vertical plane; each respective corner of said plurality of corners being of rounded configuration having a first radius; each said shelf being terminated adjacent said well by a boundary having a second radius, said second radius being greater than said first radius, each said shelf presenting a second abutting surface for engaging a similar first abutting surface of an adjacent upper receptacle in a nested orientation.

3. An improved receptacle adapted for nested stacking, said receptacle having a generally planar, generally horizontal polygonal bottom and a plurality of walls, said bottom and said plurality of walls cooperating to form an open-topped well having a plurality of rounded corners defined by a first radius and a top end, said plurality of walls being convergently oriented toward said bottom, the improvement comprising:

a plurality of stop means for limiting depth of insertion of adjacent receptacles in a nested orientation, said plurality of stop means being distributed among said plurality of corners, each of said plurality of stop means comprising an integrally formed depression and an associated shelf in each respective corner of said plurality of corners; each said shelf being generally planar and generally horizontal; each said shelf having a boundary adjacent said well, said boundary being defined by a second radius, said second radius being greater than said first radius, said depression having a first portion and a second portion, said first portion depending outwardly of said well substantially from said boundary and extending beyond a vertical line intersecting said boundary, said second portion joining said first portion with said respective corner and presenting a first abutting surface, each said shelf presenting a second abutting surface, whereby in a nested stack of the receptacles said first abutting surface of a respective receptacle engages the second abutting surface of an adjacent lower receptacle.

* * * * *

UNITED STATES PATENT AND TRADEMARK OFFICE

CERTIFICATE OF CORRECTION

PATENT NO. : 5,035,327
DATED : July 30, 1991
INVENTOR(S) : Dirk E. Denzin; Robert E. Lull; Alan J. Schommer It is certified that error appears in the above-identified patent and that said Letters Patent is hereby corrected as shown below:

At column 4, line 63, delete "6" and substitute therefor --56--.

At column 4, line 65, delete "4" and substitute therefor --24--.

In claim 3, column 7, line 21, replace "adapted" with --adaptable--.

In claim 3, column 8, line 14, replace "," with --;--.

Signed and Sealed this

Thirteenth Day of February, 2001

Nicholas P. Godici

*Attest:*

NICHOLAS P. GODICI

*Attesting Officer*

*Acting Director of the United States Patent and Trademark Office*